US006378528B1

(12) United States Patent
Beeson et al.

(10) Patent No.: US 6,378,528 B1
(45) Date of Patent: Apr. 30, 2002

(54) CIGARETTE WITH IMPROVED TOBACCO SUBSTRATE

(75) Inventors: Dwayne William Beeson, Kernersville; Gary Roger Shelar, Greensboro; Chandra Kumar Banerjee, Pfafftown; Billy Tyrone Conner, Greensboro; Randall Allison Hoots, Yadkinville, all of NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 09/400,585

(22) Filed: Sep. 22, 1999

(51) Int. Cl.[7] ..... A24B 15/00

(52) U.S. Cl. ..... 131/352; 131/365; 131/359; 131/194; 131/335; 131/353; 131/355; 162/139

(58) Field of Search ..... 131/365, 359, 131/194, 335, 352, 353, 355; 162/139

(56) References Cited

U.S. PATENT DOCUMENTS 5,415,186 A * 5/1995 Casey, III et al. ..... 131/194

* cited by examiner

*Primary Examiner*—Stanley S. Silverman
*Assistant Examiner*—Mark Halpern

(57) ABSTRACT

An improved substrate for use in smoking articles is produced by infusing aerosol forming material into tobacco. The infusion can take place in one or multiple steps. Preferably, about 10% to about 40% by weight of aerosol former, such as glycerin is infused into strip tobacco at elevated temperatures. The tobacco containing the aerosol former may then be dried, equilibrated to ambient conditions and/or blended with tobacco which does not have added aerosol former. Preferably the resulting material is again infused with an additional about 5% to about 15% by weight of aerosol former, at elevated temperatures. The new substrate material, and the method for making it, result in a substrate which has reduced migration of aerosol former and substantially improved manufacturing characteristics.

30 Claims, 2 Drawing Sheets

CIGARETTE WITH IMPROVED TOBACCO SUBSTRATE

BACKGROUND OF THE INVENTION

The present invention relates to smoking articles such as cigarettes, and in particular, to those smoking articles having a short fuel element and a physically separate aerosol generating means. These smoking articles are capable of providing the smoker with the pleasures of smoking (e.g., smoking taste, feel, satisfaction, and the like). The invention particularly relates to improved methods for making improved substrates for use in such smoking articles.

Cigarettes, cigars and pipes are popular smoking articles which use tobacco in various forms. Many products have been proposed as improvements upon, or alternatives to, the various popular smoking articles. For example, numerous references have proposed articles which generate a flavored vapor and/or a visible aerosol. Most of such articles have employed a combustible fuel source to provide an aerosol and/or to heat an aerosol forming material. See, for example, the background art cited in U.S. Pat. No. 4,714,082 to Banerjee et al.

A number of smoking articles have been designed and produced having a short carbonaceous fuel element and a physically separate aerosol generating means. Smoking articles of this type, as well as materials, methods and/or apparatus useful therein and/or for preparing them, are described, for example, in U.S. Pat. No. 4,708,151 to Shelar; U.S. Pat. No. 4,714,082 to Banerjee et al.; U.S. Pat. No. 4,732,168 to Resce; U.S. Pat. No. 4,756,318 to Clearman et al.; U.S. Pat. No. 4,782,644 to Haarer et al.; U.S. Pat. No. 4,793,365 to Sensabaugh et al., and the patents cited in U.S. Pat. No. 5,546,965, the disclosures of which are incorporated herein by reference.

Many of the smoking articles described in the prior art employ a combustible fuel element for heat generation and an aerosol generating means positioned physically separate from, but often in a heat exchange relationship with, the fuel element. The aerosol generating means typically includes one or more aerosol forming substances such as glycerin and a carrier or substrate therefor. During smoking, heat generated by the fuel element acts to volatilize the aerosol forming substances, thereby providing an aerosol which resembles tobacco smoke.

Many of the prior art smoking articles employ a substrate as a carrier for the aerosol forming substance in the aerosol generating means. Typically these substrates have been noncombustible solids, e.g., graphite, carbon, alumina, and the like, which are deemed heat-stable under the operating conditions of the smoking articles using them. In such articles the substrate was exposed to temperatures in the range of 400°–800° C., necessitating a heat-stable material. In U.S. Pat. Nos. 5,182,062 and 5,203,355 the substrate material was a cellulosic material such as a gathered paper, bearing an aerosol forming material at a loading level ranging from about 100% to about 400% by weight.

Such smoking articles often additionally include tobacco in various forms such as cut filler, reconstituted tobaccos, densified pellets, tobacco dust and tobacco extracts, as well as tobacco flavor modifiers and tobacco flavoring agents. Such tobacco components are included in addition to the substrate bearing the aerosol forming material, which is the prime source of aerosol former for smoke generation. The tobacco components can also add aerosol and/or flavorants to the smoke generated by the substrate, to enhance the volume, flavor, or other qualities of the smoke ultimately provided to the smoker.

Some such smoking articles have previously utilized tobacco supersaturated with aerosol forming materials as substrates. Such substrates provided good quantities of aerosol, but were difficult to make and difficult to incorporate into the smoking articles.

Indeed, substrates for use in such smoking articles, whether or not they incorporated tobacco, have tended to be expensive to make and difficult and expensive to manufacture into the finished product. Aerosol formers, such as glycerin, tended to migrate from the substrates, especially if the substrates were loaded with high amounts of the aerosol former, so that a visible wet ring of aerosol former would often form around the substrate portion of the smoking article. Migration of substrate could also have a deleterious effect on the storage or shelf-life of the smoking articles, which typically have to be stored for extended periods in warehouses which are often hot, or otherwise conducive to loss of aerosol former. Typically smoking articles should be able to produce adequate aerosol even after storage for up to seven months at 88° F. and 80% relative humidity.

The present invention represents an improvement in substrates for smoking articles, wherein the heat-stable substrate is wholly or partially replaced by tobacco or tobacco-containing compositions, which themselves bear a high load of aerosol former. The invention is particularly directed to methods of making improved tobacco substrates containing substantial amounts of aerosol formers, and of making smoking articles incorporating such substrates.

SUMMARY OF THE INVENTION

The present invention provides improved substrate material for cigarettes and other smoking articles employing short fuel elements and physically separate aerosol generating means. The substrate is a tobacco material bearing a substantial amount of an aerosol forming composition. The tobacco substrate is manufactured in a way which permits it to be made into substrate elements for inclusion in smoking articles in a manner similar to the manufacture of tobacco cigarettes.

The substrates of the present invention are tobacco materials; that is, they primarily comprise tobacco, although additives and fillers may be included in the substrate. Preferred tobacco materials used as substrates herein are flue cured, Turkish, expanded tobacco, expanded stems, and traditional blend ratios of the known tobacco types. Preferably the tobacco utilized in the substrate is cellular tobacco material, e.g., cut tobacco leaf or the like, in which a substantial percentage of the tobacco plant cells remain. Other types of tobacco, such as reconstituted tobacco sheet, can be added in minor proportions for flavor enhancement, but it is preferred that the majority of the tobacco be cellular tobacco material.

The preferred type of tobacco used for the substrates of the present invention is flue-cured tobacco, particularly tobacco which has been cured using heated air only, without substantial contact with products of combustion of the fuel used to heat the air.

Prior to conversion into the substrate material of the present invention, the tobacco may be in the forms of sheets, webs, strands, filaments, strips, shredded tobacco and the like. Preferably, the substrate material starts as strip tobacco, which is the form of tobacco produced when tobacco leaf is deveined. The strip tobacco is contacted and infused with aerosol former. Preferably such contact takes place in a casing drum, which is a rotating drum liquid/solid contact device. Casing drums are known per se in the tobacco industry, and have long been used to add relatively small amounts (e.g., about 3%–6% by weight) of moisture, emollients (including glycerin) and/or flavorants to tobacco. The tobacco material is preferably continuously fed to one end of the rotating drum, which has a series of baffles to agitate and convey the tobacco to the other end of the drum.

As the tobacco traverses the rotating drum, it is intimately contacted by aerosol former in liquid form, whereby the aerosol former becomes sorbed by the tobacco material. The aerosol former is in liquid form, preferably in an aqueous solution, since the presence of water typically reduces the viscosity of the aerosol former, which aides in penetration of the aerosol former into the tobacco material. Preferably the aerosol former solution is applied by pressure nozzles spaced throughout the casing drum. Alternatively or additionally, steam can be injected into the casing drum to heat and humidify the tobacco being processed, thus improving infusion of the aerosol former.

Preferred aerosol formers include the polyhydric alcohols, such as glycerin, propylene glycol, triethylene glycol and tetraethylene glycol), the most preferred being glycerin. Other aerosol formers may also be used, such as the aliphatic esters of mono-, di- or poly-carboxylic acids (e.g., methyl stearate, dimethyl dodecandioate, and dimethyl tetradcanedioate), Hystar TPF, available from Lonza, Inc., and the like, as well as mixtures of any of those materials.

Preferably the aerosol former is applied in the form of an aqueous solution containing about 40% to about 90% by weight aerosol former, with the balance water. Preferably the aerosol solution contains about 70% to about 80% by weight glycerin, most preferably about 75% by weight glycerin. While addition of water helps reduce viscosity of the glycerin, addition of too much water prevents the tobacco from taking the high loading of aerosol former. Moreover, most of the water picked up by the tobacco in this process has to be removed before the material can be used as a substrate in a smoking article.

The aerosol former solution is preferably heated in order to further enhance infusion of the aerosol former into the tobacco. The temperature of the solution can vary from about 100° F. (about 38° C.) to about 150° F. (about 66° C.), preferably about 120° F. (about 49° C.) to about 140° F. (about 60° C.), most preferably at about 130° F. (about 54° C.).

Optionally, or additionally, the tobacco can also be heated and humidified by injection with steam during the infusion of the aerosol former solution. Sufficient steam is injected into the casing drum to raise the tobacco temperature to about 100° F. (about 38° C.) to about 160° F. (about 70° C.), preferably about 120° F. (about 49° C.) to about 140° F. (about 60° C.), most preferably at about 130° F. (about 54° C.).

The amount of aerosol former solution applied to the tobacco is determined by the desired loading of the resulting tobacco. Thus the feed rate of the aerosol former liquid is adjusted, in accordance with the feed rate of the tobacco to the casing drum, to provide the proper loading level on the resultant tobacco substrate. Preferably a small excess of aerosol former is applied to the tobacco, to make up for aerosol former lost during the process.

The aerosol loading desired as a result of this process step depends somewhat upon the nature of the overall process used. In most applications of aerosol former in accordance with this invention, aerosol former will be applied in at least two stages, the first being the above-described process, which is followed by drying, optional blending with other tobaccos, followed by another aerosol former infusion step, to bring the tobacco to the final desired loading level, as discussed above. In such a case, the desired loading of the aerosol former from the initial infusion step is about 20% to 40% by weight, preferably about 25% to 35% by weight, most preferably about 30% by weight.

Once a desired level of aerosol former is achieved in the shredded tobacco, the material is dried to reduce the moisture content to an acceptable level. Preferably this is done in a continuous oven, with the impregnated tobacco being exposed to air in a temperature range which is high enough to reduce the moisture content, without driving off a substantial portion of the aerosol former from the tobacco. Preferably the tobacco is dried in a continuous forced hot air oven, under conditions such that the tobacco temperature can reach up to about 175° F.

In the preferred method, where aerosol former is added in two stages, it is preferable to dry the treated tobacco to a moisture content of about 5%–15% by weight, preferably about 8%–12% by weight.

After drying, the loaded tobacco can be equilibrated for a period of time at room temperature and relative humidity, before the next treatment stage. At this time, also, other, untreated tobacco or tobacco materials may be blended with the treated material, for flavor or ease of manufacture. For example, about 5% to 15% of burley tobacco, Turkish tobacco, or reconstituted tobacco sheet can be blended with the treated tobacco.

The next stage is a further treatment in a casing drum, followed by cutting the shredded treated tobacco prior to manufacture of the finished substrate. The treated tobacco, with or without the blended, non-treated tobacco, is treated in a casing drum with aerosol former solution as described above to the point where 3% to 15% by weight of additional aerosol former is infused into the material. The aerosol former materials and conditions are preferably as described above for the first stage infusion. The amount of aerosol former contained in the resulting tobacco substrate is from about 25% to about 50% by weight, preferably from about 30% to about 40% by weight. The resulting material also has a substantial amount of moisture at this stage, e.g., 15% to 25% by weight.

The resulting tobacco substrate material is fed to a standard tobacco cutter, and cut, e.g., at 28 cuts per inch.

From the cutter, the cut tobacco substrate is then dried to below about 6% by weight moisture, preferably to about 3% to 4% by weight moisture, preferably without driving off a substantial portion of the aerosol former from the tobacco. Preferably the tobacco is dried in a continuous forced hot air oven, under conditions such that the tobacco temperature does not exceed about 175° F.

Once dried, the cut tobacco substrate is ready to be formed into rod shape, circumscribed with a wrapper, cut into substrate elements, and then combined with fuel elements and other structures to make the completed smoking device, as further described below.

As described above, the preferred smoking article includes a short (i.e., less than about 30 mm in length prior to smoking) preferably carbonaceous, combustible fuel element. Typically, the fuel element is an extruded mass, about 12 mm in length and about 4.2 mm in diameter which is provided with a plurality of longitudinally extending passageways, i.e., defined longitudinal hole(s) passing through the inner portion of the fuel element, and/or grooves located on the periphery of the fuel element.

The passageways provide a surface area which assists in the lighting of the fuel element, and in maintaining burning of the fuel element during smolder. The passageways also aid in controlling the heat transfer from the fuel element to the aerosol generating means. The density of a typical fuel element ranges from about 0.8 to about 1.3 g/cc. Fuel elements of this type are well known in this art.

Typically, the fuel element may be circumscribed by an insulating material in the form of a jacket. Jackets of this type are well known in the art, and a preferred jacket used herein includes alternating layers of glass fibers and tobacco paper.

The cigarette further includes an aerosol generating means which includes the substrate made in accordance with the present invention, which bears at least one aerosol forming material, and which is formed into a continuous rod or substrate tube assembly on a conventional cigarette making machine. Typically the overwrap material for the rod is a barrier material such as a paper foil laminate. The foil serves as a barrier, and is located on the inside of the overwrap.

The barrier material for making the tube aids in preventing migration of the aerosol former to other components of the cigarette. The barrier material forming the tube is typically a relatively stiff material so that when formed into a tube it will maintain its shape and will not collapse during manufacture and use of the cigarette.

An appropriate length of the jacketed fuel element is combined with a substrate section or substrate tube assembly by a wrapper material, which has a propensity not to burn, to form a fuel/substrate section. In preferred embodiments of the cigarettes, the wrapper typically extends from the mouthend of the substrate section, over a portion of the jacketed fuel element, whereby it is spaced from the lighting end of the fuel element. The wrapper material assist in limiting the amount of oxygen which will reach the burning portion of the fuel element during use, preferably thereby causing the fuel element to extinguish after an appropriate number of puffs. In especially preferred embodiments of the cigarette, the wrapper is a paper/foil/paper laminate. The foil provides a path to assist in dissipating or transferring the heat generated by the fuel element during use. The jacketed fuel element and the substrate section are joined by the overwrap.

The preferred cigarette smoking articles of the present invention also include a roll or charge of tobacco, normally in cut filler form, wrapped in a wrapping material such as paper, thereby forming a tobacco rod, and joined by the wrapped paper to the mouthend of the aerosol generating means. A preferred tobacco roll is formed from cut filler comprising a reconstituted tobacco material. Alternatively, the tobacco charge can be in another processed form, such as volume expanded cut filler or aqueous extracted/volume expanded cut filler.

Preferred smoking articles also include a mouthend piece for delivering aerosol to the smoker, which in the case of cigarettes, typically have a tubular shape. However, the mouthend piece may be provided separately, e.g., in the form of a cigarette holder, or as a pipe. The mouthend piece of the preferred smoking articles typically includes a filter plug segment. Preferred filter segments exhibit low filtration efficiencies so as to minimize interference with the passage of aerosol from the aerosol generating means to the mouth of the smoker during draw (i.e., upon use). A segment of flavor-containing material, such as a loosely gathered or pleated tobacco paper or menthol-containing pleated carbon filled sheet can be included between the aerosol generating means and the filter segment. Examples of suitable mouthend pieces are well known in this art.

DETAILED DESCRIPTION OF THE PREFERRED EMBODIMENTS

Figure 1:
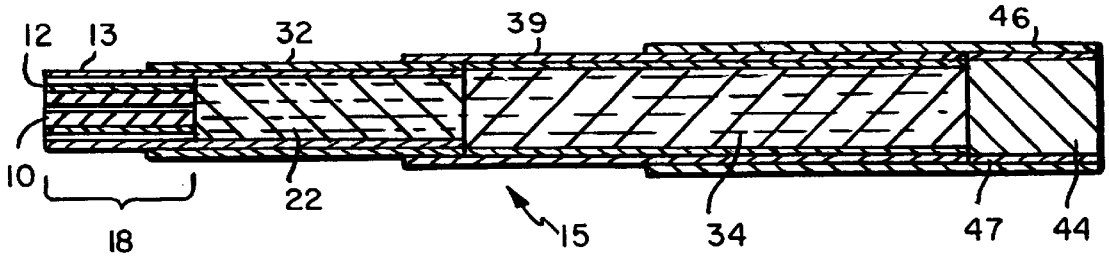
FIG. 1 is a longitudinal sectional view of a cigarette embodying a substrate of the present invention.

In FIG. 1, an embodiment of the cigarette 15 of the present invention is illustrated. The cigarette includes a fuel element 10 circumscribed within a retaining jacket of insulating material 12. The insulating and retaining jacket material 12 preferably comprises glass fibers. The jacketed fuel element structure is referred to herein as jacketed fuel element 18.

As pointed out and depicted in U.S. Pat. No. 5,819,751, the disclosure of which is incorporated herein by reference, the fuel element 10, which preferably is an extruded carbonaceous material, is generally cylindrical in shape and has a plurality of longitudinally extending peripheral channels.

The insulating and retaining jacket 12 has an intermediate layer 14 of tobacco paper positioned between two layers of glass fibers. Surrounding the insulating and retaining jacket 12 is paper wrapper 13. Wrapper 13 may comprise one or more layers which provide appropriate porosity and ash stability characteristics.

Situated longitudinally behind the jacketed fuel element 18 is an aerosol generating means comprising substrate 22. In FIG. 1, the substrate 22 is advantageously made from a tobacco cut filler material made in accordance with the present invention.

Circumscribing the jacketed fuel element and spaced from the lighting end thereof is a non-burning or foil-backed (e.g., aluminum or other metal) paper wrapper 32, which also extends over the substrate section 20. Wrapper 32 is preferably a non-wicking material which prevents the wicking of the aerosol forming material(s) from the substrate 22 to the fuel element 10, the insulating jacket 12, and/or from staining of the other components of the cigarettes. This wrapper also minimizes or prevents peripheral air (i.e., radial air) from flowing to the portion of the fuel element disposed longitudinally behind its front edge, thereby controlling combustion of the fuel element by causing oxygen deprivation, and preventing excessive combustion.

Positioned rearwardly and adjacent to the substrate section 20 is a tobacco section or component 34. In FIG. 1, the tobacco section 34 is a roll of reconstituted tobacco cut filler, circumscribed by paper wrapper 39.

Positioned at the extreme mouth end of the cigarette is a low-efficiency filter element 44 including a filter material, such as a gathered web of non-woven polypropylene fiber, cellulose acetate, or the like, overwrapped with a plug wrap 47. In FIG. 1, the filter abuts the tobacco section 34, and is combined with the tobacco section by means of a tipping paper or tipping wrapper 46.

In use, the smoker lights fuel element 10 which burns to produce heat. During draw, air passes along the periphery of the burning portion of the fuel as well as through the retaining and insulating jacket 12. The drawn air is heated by contacting the burning portion of the fuel element and by heat radiated from the fuel element. The heated air transfers heat by convection to the substrate 22. The transferred heat volatilizes the aerosol forming and flavor materials carried by the substrate. The volatilized material within the hot drawn air exits the substrate. As the volatilized material cools during passage through the remainder of the substrate and through the tobacco section, an aerosol is formed. The aerosol passes through the tobacco section, absorbing tobacco flavors, and passes through the filter material 44, and into the mouth of the smoker.

Since the rear end portion of the fuel element does not normally burn during use of the cigarette, the fuel element remains securely in the cigarette and does not have a tendency to become dislodged from the cigarette during use. When the fuel element self-extinguishes and no longer generates heat, the cigarette is disposed of.

Figure 2:
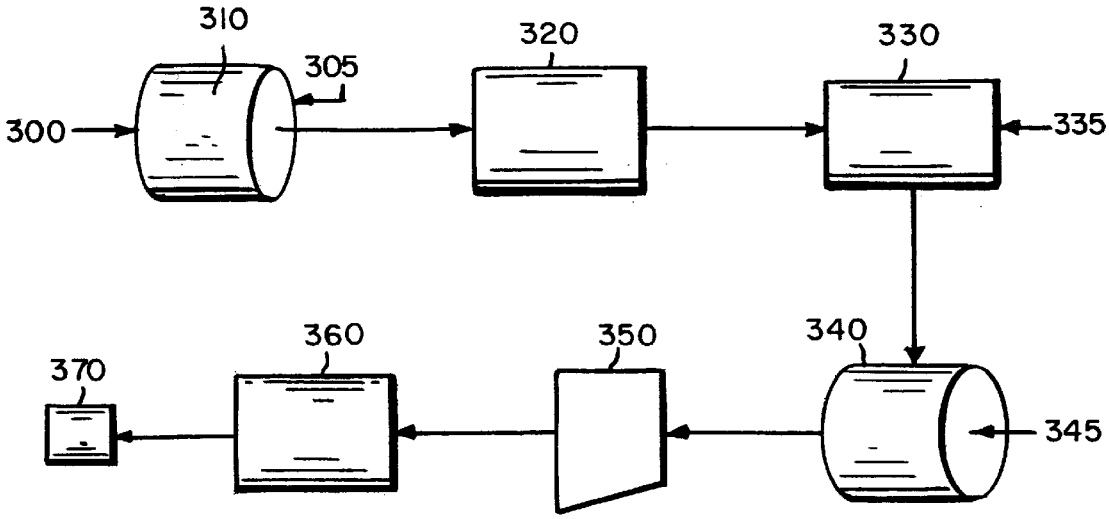
FIG. 2 illustrates a flow diagram of one preferred method of making the tobacco substrates of the present invention.

FIG. 2 depicts a flow diagram showing one embodiment of the method of making the tobacco substrate in accordance with the present invention.

Strip tobacco 300, e.g., flue cured tobacco in strip form , enters casing drum 310 for infusion of aerosol forming material 305. Material 305 is preferably glycerin, in the form of an aqueous solution, containing, e.g., 75% glycerin by weight. Preferably the glycerin solution is heated to increase the penetration and ease the infusion of the glycerin into the tobacco material 300. Preferably, the amount of glycerin infused into tobacco 300 is sufficient to provide a loading of about 20% to 40% by weight, preferably about 25% to 35% by weight, most preferably about 30% by weight.

Optionally, steam can also be injected into the casing drum, to increase uptake of the aerosol former by the tobacco being treated.

From casing drum 310, the treated material is transferred to drier 320, where the moisture introduced during the treatment with the aerosol former is reduced. Preferably, drier 320 is a continuous forced air oven, regulated to heat the tobacco to a temperature no t exceeding about 175° F. In that way, the moisture is reduced without excessive loss of aerosol former.

From drier 320, the treat ed tobacco is normally transferred to a holding area 330, where it may equilibrate with ambient conditions. If desired, the treated tobacco can be blended with a portion of untreated tobacco 335, which can contribute flavor or runability characteristics to the blend.

The next stage is the second infusion of aerosol former, which takes place in casing drum 340. Conditions are preferably similar to those operated in casing drum 310, although the aerosol former solution 345 may be the same as solution 305, or it may be different. The conditions and amounts of materials added at casing drum 340 are preferably sufficient to provide an additional pickup of about 3% to 15% by weight of additional aerosol former infused into the tobacco.

From casing drum 340, the tobacco is put through a standard tobacco cutter 350, preferably cutting at about 28 cuts to the inch.

The cut, fully treated tobacco is then dried in drier 360, which is similar in operation to drier 320. Here however, the moisture content is reduced substantially, with the resulting tobacco substrate material having less than 6% moisture by weight, preferably 3–4% moisture by weight.

From the drier 360, the tobacco substrate material is preferably transferred to a holding area 370, where it can equilibrate with atmospheric conditions before being formed into a tube, and combined with the fuel element components 18 to form a substantial portion of the ultimate cigarette. That process is described in connection with FIG. 3.

Figure 3:
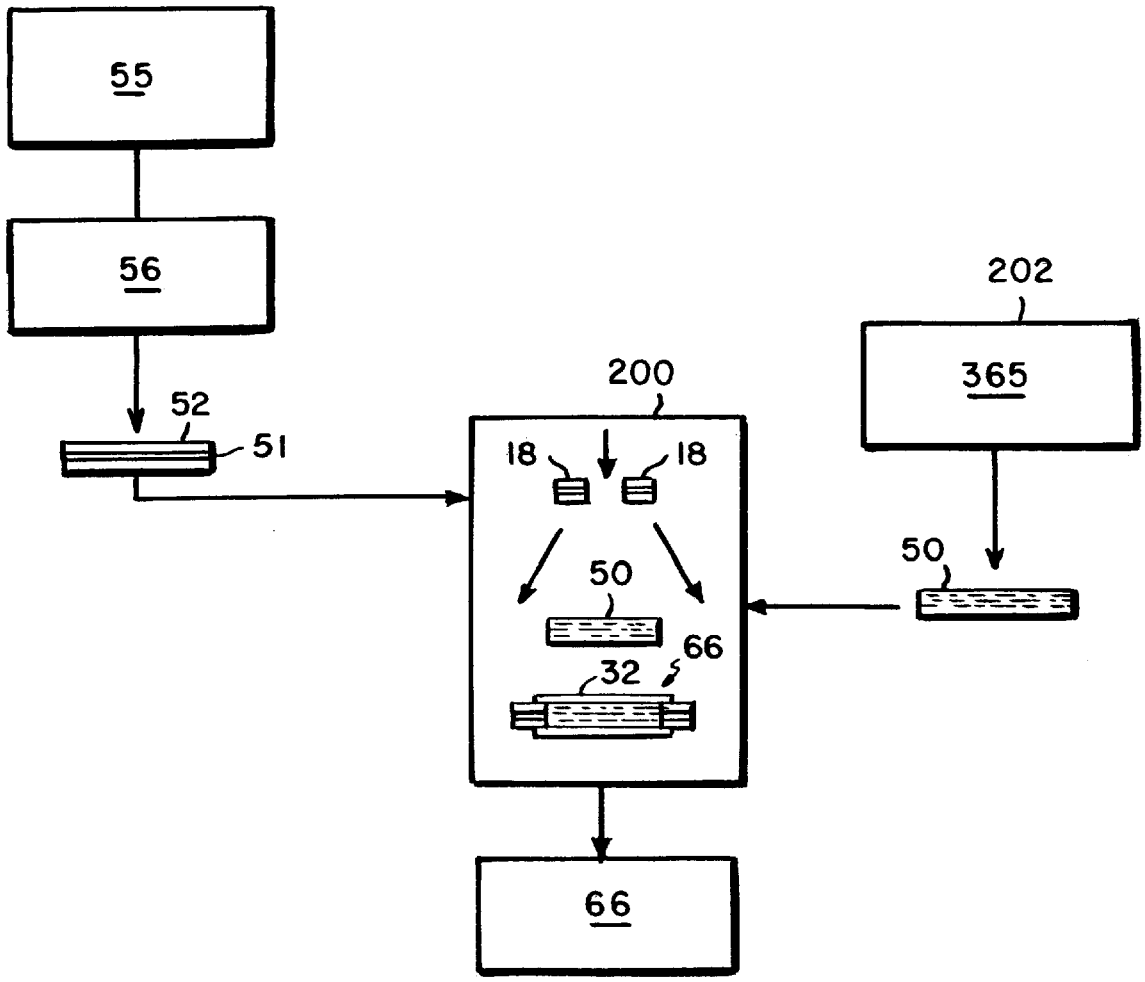
FIG. 3 illustrates a flow diagram of one preferred method of joining the tobacco substrates of the present invention to the fuel element of the preferred smoking article.

In FIG. 3 there is shown a flow diagram of one preferred method for manufacturing the combined fuel element and aerosol generator segment of cigarette embodiments of the present invention illustrated in FIG. 1 The method involves separately manufacturing the various cigarette components such as the jacketed fuel element, substrate section, tobacco section and filter followed by combining the individually prepared components in a specified sequence. The present disclosure focuses on the manufacture and combination of the jacketed [1] fuel element and the substrate section. The manufacture and combination of and P with the other segments of the cigarette are described in U.S. Pat. No. 5,819,751, the disclosure of which is hereby incorporated by reference herein. As disclosed therein, e.g., at Col. 7, 1.45 to Col. 8, 1.61, a carbonaceous fuel rod 51 of the desired size and shape may be formed by extruding a carbonaceous paste through extruder 55. The extruded fuel rod is then wrapped in an insulating material and outer paper wrapper at station 56, to produce the jacketed fuel element 52.

The substrate rod 50 is formed by providing the tobacco substrate cut filler material bearing the aerosol former, as described in connection with FIG. 2 herein. The cut filler material is formed into a continuous rod and overwrapped with a wrapper using a cigarette making machine 202 such as a Protos, available from Körber, and cut into rod lengths of 62 mm or 2-up lengths. The substrate rods can be provided by using a KDF-2 rod making apparatus from K örber & Co., A.G., Hamburg, Germany (Körber). Other suitable apparatus is also known. See, e.g., U.S. Pat. No. 4,807,809 to Pryor, et al. Rod forming units are also available as CU-10, CU-20 or CU-20S from Decoufle s.a.r.b.

Preferred substrates retain the aerosol forming material when not in use, and release the aerosol forming material during the smoking period.

The outer wrapper which circumscribes the gathered substrate material is preferably a paper material and can be coated or treated with a material so as to limit migration of the aerosol forming material. An example of such a coating is Hercon 70 available from Hercules, Inc., or a metal foil, with or without a paper layer on one or both sides of the foil.

The continuous substrate rod is cut into substrate rods 50 approximately 60 mm in length and fed into suitable conveying means for conveying the rods to the next assembly station. Suitable conveying means for the various subassemblies described herein include batch conveyors, such as an HCF 80 tray filler, available from Körber, or continuous conveyors, such as pneumatic or other conveyor apparatus known in the art.

If desired, the jacketed fuel rod may be dried to reduce the moisture content of the carbonaceous rod. Preferably the moisture content should be maintained at an appropriate level so that the carbonaceous rods can be cut during subsequent manufacturing steps without fracturing or chipping. The dryer used (not shown) can be a passive drying apparatus such as a timed accumulator system (e.g., a Resy available from Körber, or S-90, available from G. D Societe Per Azioni, Bologna, Italy, optionally in a humidity controlled environment) or a positive drying system such as a hot air blower system.

The use of the preferred tobacco substrates of the present invention have had two unique effects on the methods for making the fuel elements and the methods of combining them with the substrate sections. First, because the loading of aerosol former on the tobacco substrate is not as high as in the case of previous substrate, the long fought problem of aerosol former migration from the substrate to the fuel element has been substantially improved.

On the other hand, because of the absorbtive nature of the tobacco, contact of the substrate rods with carbonaceous fuel rods which have high moisture contents, e.g. above 12%, especially above 18%, may cause migration of the moisture from the fuel element into the tobacco substrate. The presence of high moisture in the tobacco substrate can cause difficulty with the cutting knives that cut the tobacco substrate rod for joining with the rest of the smoking article. The knives can gum up and become unusable until they are shut down and cleaned.

At the same time, as indicated above, the carbonaceous rods cannot easily be cut unless their moisture level is rather high.

The solution to the problem has been to pre-cut the fuel elements, and dry them before joining them with the tobacco substrate element. Preferably, the fuel elements are dried to less than 8% moisture, more preferably about 4% to 5% moisture on the fuel element, and that avoids the moisture migration problem, and thus the problem with gummy knives.

It has also been found advantageous to dry the tobacco substrate element to less than 6%, preferably about 3–4%. As a result, both the gummy knife problem and the aerosol former migration problem have been resolved. As indicated further below, the resolution of the aerosol former migration problem has provided the cigarettes made with the substrates in accordance with this invention with surprisingly increased shelf life and improved shelf life properties.

In order to combine the fuel elements and the substrate element, the jacketed fuel rods are fed to a tipping unit such as a Max R-1, available from Körber. Thus jacketed fuel rod 52 is cut into 72 mm or 6-up lengths, and fed into a Max-1 tipper unit 200.

The substrate rod 50 is formed and cut into 42 mm two-up lengths, and are fed into a hopper of the Max-1 Unit 200.

In the tipper unit 200, the 72 mm jacketed fuel rods are cut into lengths of about 12 mm to form jacketed fuel elements 18. The jacketed fuel elements 18 are combined with substrate 50 using an overwrap 32, which is approximately 50 mm in length, and is applied so that it extends the full length of two-up rod 50, and overlaps approximately 4 mm over the adjacent jacketed fuel elements 18.

The combined fuel/substrate section is then preferably combined with a tobacco roll and a mouthend piece, as described, for example, in U.S. Pat. No. 5,819,751.

The following examples are provided in order to further illustrate various embodiments of the invention, but should not be construed as limiting the scope thereof. Unless otherwise noted, all parts and percentages are by weight.

EXAMPLE 1

Flue cured tobacco was mixed with 10%, 20%, 30% and 40% by weight of glycerin in a batch mixer. One hundred gram lots of the tobacco/glycerin mixtures were then treated in a microwave oven for 30 seconds, mixed again and microwaved for an additional 30 seconds, to incorporate the glycerin into the tobacco. These tobacco/glycerin mixtures were hand packed into a paper-wrapped substrate rod, at a loading of about 250 mg. per cigarette. 21 mm segments of the substrate rod were joined with the jacketed fuel elements, and made into cigarettes as generally described above, by joining with the other components.

EXAMPLE 2

A substrate was prepared in a two stage infusion process. In a first stage, 10% by weight glycerin was applied to tobacco strip in a pill coater. The material was cut to 28 cuts per inch. Thereafter it was subjected to a second infusion step, with an additional 20% glycerin being added to the substrate in the same manner. The resulting material was dried to a final moisture content of 6% by weight, and processed into cigarettes as generally described above, using a Protos cigarette making machine. The manufacturing of the finished substrate section was extremely smooth. Smoking of the resulting cigarettes produced substantial aerosol, both initially, and after storage for up to 7 months, both at ambient conditions of 75° F. and 40% relative humidity, and at conditions of 88° F. and 80% relative humidity.

EXAMPLE 3

Cigarettes were made as described above, using substrate tobacco prepared in a two stage infusion process. In the first stage, various levels of 20%, 25%, 30% and 35% glycerin were added to flue cured shredded tobacco by contacting the tobacco with an aqueous mixture containing 75% glycerin in a casing drum. The resulting tobacco substrate was dried in a continuous oven by heating the tobacco material to a maximum temperature of about 175° F. Thereafter, the dried substrate was stored and allowed to equilibrate to ambient conditions. The equilibrated tobacco was similarly infused with an additional 5%, 10% or 15% by weight of glycerin in a second casing drum. After drying to about 3% to 6% moisture, the resulting substrate material had a total glycerin content ranging from 30–40% by weight. Optimum glycerin application resulted in 30% glycerin inclusion from the first infusion step, and 5% infusion during the course of the second infusion step.

In some cases, Tobaccos and blends without added glycerin were mixed in with the product of the first infusion step, at loading levels of about 10%, 20% and 30% by weight.

Smoking of the cigarettes provided substantial aerosol production, both immediately after manufacture, and after storage up to seven months, both at ambient conditions, and under conditions of 75° F. and 40% relative humidity, and under conditions of 88° F. and 80% relevant humidity.

The present invention has been described in detail, including the preferred embodiments thereof. However, it will be appreciated that those skilled in the art, upon consideration of the present disclosure, may make modifications and/or improvements on this invention, and still be within the scope and spirit of this invention, as set forth in the following claims.

What is claimed is:

1. A method of making a substrate for a smoking article, comprising (a) incorporating about 10% to about 40% by total weight of an aerosol former into a tobacco material by heating a composition comprising the aerosol former to a temperature of about 100° F. to about 150° F. and contacting the heated aerosol former composition with the tobacco material, (b) heating the tobacco material containing the aerosol former to form a substrate material, and (c) forming the substrate material into a substrate.

2. The method of claim 1, wherein the heating of the tobacco material containing the aerosol former takes place in an oven.

3. The method of claim 1, further comprising heating the tobacco material which contacts the heated aerosol former composition.

4. The method of claim 1, wherein the amount of aerosol former incorporated into the tobacco material is from about 25% to about 35% by total weight.

5. The method of claim 1, wherein the aerosol former composition is heated to a temperature of about 120° F. to about 140° F.

6. The method of claim 1, wherein the tobacco material which contacts the heated aerosol former composition is heated to a temperature of about 100° F. to about 160° F.

7. The method of claim 6, wherein the tobacco material which contacts the heated aerosol former composition is heated by injection of steam during the contact of the tobacco material with the aerosol former.

8. The method of claim 7, wherein the aerosol former is incorporated in tobacco material by contacting the tobacco material with an aqueous solution of the aerosol former.

9. The method of claim 8, wherein the aqueous solution contains about 40% to about 90% by total weight of the aerosol former.

10. The method of claim 8, wherein the contact of the tobacco material and the aqueous solution of aerosol former takes place in a rotating drum liquid/solid contact device.

11. The method of claim 8, wherein the aerosol former is glycerin.

12. The method of claim 1, wherein the tobacco material comprises strip tobacco.

13. The method of claim 1, wherein the aerosol former composition consists essentially of an aqueous solution containing about 40% to about 90% by total weight of aerosol former.

14. The method of claim 1, wherein the heating of the tobacco material in step (b) is controlled so that the tobacco material does not exceed about 175° F.

15. The method of claim 1, further comprising equilibrating the dried tobacco material from step (b) with ambient atmosphere, prior to forming the substrate material into a substrate.

16. A method of making a substrate material for a smoking article, comprising:

(a) contacting a tobacco material with an aerosol former composition to incorporate about 10% to about 35% by total weight of aerosol former into the tobacco material;

(b) drying the resulting tobacco material; and (c) contacting the resulting tobacco material with an aerosol former composition to incorporate about 5% to about 20% by weight of additional aerosol former into the tobacco material.

17. The method of claim 16, wherein the aerosol former composition is heated to about 100° F. to about 150° F. prior to contacting the tobacco material.

18. The method of claim 16, wherein the tobacco material is dried to a moisture content between about 5% and 15% in step (b).

19. The method of claim 16, further comprising equilibrating the dried tobacco material from step (b) with ambient atmosphere, prior to further contact with an aerosol former composition.

20. The method of claim 16, further comprising (d) cutting the tobacco material produced by step (c), to produce a cut substrate material.

21. The method of claim 20, further comprising drying the cut substrate material to a moisture content of below about 6% by weight.

22. The method of claim 20, further comprising forming the cut substrate material into a cylindrical substrate.

23. The method of claim 22, further comprising overwrapping the formed cylindrical substrate with a material which limits migration of aerosol forming material.

24. A formed, wrapped substrate for a smoking article, comprising the substrate made in accordance with the method of claim 23.

25. The method of claim 16, wherein the tobacco material comprises a strip tobacco material.

26. The method of claim 16, wherein the aerosol former composition consists essentially of an aqueous solution containing about 40% to about 90% by total weight of aerosol former.

27. The method of claim 16, wherein the aerosol former composition is heated to a temperature of about 100° F. to about 150° F. before contacting the tobacco material.

28. The method of claim 16, further comprising heating the tobacco material of step (a) to a temperature of about 100° F. to about 160° F. while it is contacting the aerosol former composition.

29. The method of claim 27, wherein the tobacco material is heated by injection of steam during contact with the aerosol former composition.

30. The method of claim 16, further comprising equilibrating the dried tobacco material from step (c) with ambient atmosphere.

* * * * *